US005707456A

United States Patent [19]

Komplin et al.

[11] Patent Number: 5,707,456

[45] Date of Patent: Jan. 13, 1998

[54] METHOD FOR TREATING INK JET FOAM TO REMOVE IMPURITIES

[75] Inventors: Steven Robert Komplin; Ashok Murthy; Sean David Smith, all of Lexington, Ky.

[73] Assignee: Lexmark International, Inc., Lexington, Ky.

[21] Appl. No.: 547,695

[22] Filed: Oct. 19, 1995

[51] Int. Cl.[6] ..... B08B 9/00

[52] U.S. Cl. ..... 134/22.18; 134/22.1; 134/22.19

[58] Field of Search ..... 134/22.1, 166 R, 134/22.18, 22.19; 264/344

[56] References Cited

U.S. PATENT DOCUMENTS

| | | | |
|---|---|---|---|
| 2,766,603 | 10/1956 | Zelkowitz | 134/166 R |
| 3,413,988 | 12/1968 | Butler | 134/166 R |
| 4,492,003 | 1/1985 | Boylan | 134/183 |
| 4,794,409 | 12/1988 | Cowger et al. | 346/140 |
| 4,824,487 | 4/1989 | Heffernan | 134/10 |
| 4,929,969 | 5/1990 | Morris | 346/140 |
| 4,931,811 | 6/1990 | Cowger et al. | 346/140 |
| 5,128,379 | 7/1992 | Stone | 521/50 |
| 5,182,579 | 1/1993 | Haruta et al. | 346/140 |
| 5,263,503 | 11/1993 | St. Jean | 134/166 R |
| 5,332,448 | 7/1994 | Phillips | 134/22.18 |
| 5,400,067 | 3/1995 | Day | 347/87 |
| 5,562,876 | 10/1996 | Beach et al. | 264/321 |

*Primary Examiner*—Allan R. Kuhns
*Attorney, Agent, or Firm*—John A. Brady

[57] ABSTRACT

A method and apparatus for treating a reticulated material whereby the dimensional integrity of the material is maintained. The invention includes apparatus for maintaining a length, a width and a height of a reticulated material for use in a ink jet print head during treatment of the material. In a preferred embodiment, the apparatus includes a substantially rigid chamber having an interior length, width and height which correspond substantially to the length, width, and height of the reticulated material, structure for retaining the reticulated material within the chamber, structure for introducing a treating solution into chamber, and structure for removing the treating solution from the chamber.

6 Claims, 5 Drawing Sheets

METHOD FOR TREATING INK JET FOAM TO REMOVE IMPURITIES

FIELD OF THE INVENTION

This invention relates generally to the manufacture of ink jet cartridges. More particularly, this invention relates to the treatment of reticulated ink jet foam to remove contaminants from the foam while maintaining the dimensional integrity of the foam.

BACKGROUND OF THE INVENTION

One technique for retaining ink in an ink chamber of an ink jet print head is to provide a foam element within the ink chamber prior to filling the chamber with ink. U.S. Pat. No. 5,400,067, entitled Foam Insertion For An Ink Jet Print Head Cartridge, incorporated herein by reference in its entirety, describes an exemplary method for inserting foam into the ink chamber. Interconnected void spaces within the foam enable ink to be retained in the foam and to flow from the foam for delivery to a print head.

A problem observed with the use of foam elements in ink jet printing applications is the presence of non-volatile residues ("NVR") in the foam. The foam elements are typically polyurethanes, for example, manufactured by polymerization reaction of a polyol and toluene diisocyanate. The NVR are believed to be unreacted materials which remain in the foam as impurities. Typically, such NVR remain in the foam in amounts of from about 0.5% to about 3.0% (wt).

NVR are viscous oily materials and if present in the foam in amounts greater than about 0.2% (wt.) NVR contribute to clogging and generally undesirable performance of print head cartridges. One attempt in the art to alleviate this problem has been to wash ink jet foam to reduce the amount of NVR in the foam. For example, U.S. Pat. No. 5,182,579, entitled Ink-Jet. Having Ink Storing Absorbent Material, describes washing ink jet foam with alcohol to remove manufacturing impurities. The use of isopropyl alcohol and chloroform as washing agents has been observed to be effective for removing NVR. However, it has been discovered by the present inventors that contacting the foam with solvents such as isopropyl alcohol and chloroform causes the foam to swell and thus reduces the dimensional integrity of the foam and otherwise compromises the usefulness of the foam for ink jet printing systems.

Accordingly it is an object of the present invention is to provide a method and apparatus for treating materials useful ill ink jet printing systems.

An additional object is to provide a method and apparatus useful for treating ink jet foam.

Another object of the present invention is to provide a method of the character described which effectively removes NVR from ink jet foam while maintaining the dimensional integrity of the foam.

Yet another object of the present invention is to provide a method for removing NVR from ink jet foam without swelling the foam.

A further object of the present invention is to provide a method of the character described which improves the usefulness of articles for ink jet printing.

Still another object of the present invention is to provide apparatus of the character described which is inexpensive to manufacture and easy to use.

SUMMARY OF THE INVENTION

Having regard to the foregoing and other objects, the present invention is directed to a method for treating reticulated material to remove impurities therefrom.

In accordance with the method, a reticulated material having a length, a width, and a height, interconnected void spaces within an interior region of the reticulated material, and impurities within the interconnected void spaces is positioned within an interior portion of a substantially rigid treatment chamber having a length, a width, and a height, wherein the length, width, and height of the interior portion of the treatment chamber correspond substantially to the length, width, and height of the reticulated material. The treatment chamber includes structure for introducing fluid into the interior portion of the treatment chamber and structure for removing fluid from the chamber.

A treating fluid is introduced into the treatment chamber for contacting at least some of the impurities within the interconnected void spaces of the reticulated material, the impurities being soluble in the treating fluid. A preferred treating fluid is isopropyl alcohol ("IPA"). Other suitable treating fluids include medium polarity solvents such as acetone, chloroform and methyl ethyl ketone ("MEK"). After treating the reticulated material, the treating fluid may be withdrawn from the treatment chamber to remove solubilized impurities from the reticulated material.

A rinse fluid is then introduced into the treatment chamber and thereafter removed from the treatment chamber to remove substantially all of the treating fluid from the reticulated material.

After rinsing, the reticulated material may be removed from the treatment chamber, whereby the length, width and height of the reticulated material after removal from the treatment chamber is substantially the same as the length, width, and height of the material prior to treatment.

An additional aspect of the invention provides a method for maintaining a length, a width and a height of a reticulated material for use in a ink jet print head. In accordance with the method, the reticulated material is constrained during a treatment step to remove impurities whereby the length, width and height dimensions of the reticulated material are substantially unchanged during treatment.

In accordance with yet another aspect of the present invention, the present invention is directed to apparatus for treating reticulated material having a length, a width, and a height, interconnected void spaces within an interior region of the reticulated material, and impurities within the interconnected void spaces, wherein the apparatus comprises a chamber having interior dimensions substantially the same as the length, width and height of the reticulated material to be treated.

In a preferred embodiment, the apparatus includes a treatment chamber having an interior portion with a length, a width, and a height, wherein the length, width, and height of the interior portion of the treatment chamber correspond substantially to the length, width, and height of the reticulated material.

Structure is provided for introducing a treating fluid into the interior portion of the treatment chamber for contacting and dissolving at least some of the impurities within the interconnected void spaces of the reticulated material, for removing treating fluid and dissolved impurities from the treatment chamber, for introducing a rinse fluid into the treatment chamber, and for removing the rinse fluid from the treatment chamber.

In yet another aspect, the invention provides apparatus for maintaining a length, a width and a height of a reticulated material for use in a ink jet print head during treatment of the material. In a preferred embodiment, the apparatus includes a substantially rigid chamber having an interior length, width and height which correspond substantially to the length, width, and height of the reticulated material, structure for maintaining the reticulated material within the chamber, structure for introducing a treating solution into chamber, and structure for removing the treating solution from the chamber.

In still another aspect, the invention provides a method for maintaining a felted dimension of a reticulated material for use in a ink jet print head. The method includes the steps of providing a portion of the reticulated material, cutting the material in the felt dimension, felting the material, constraining the material in the felted dimension during a treatment step to remove impurities whereby the felted dimension of the material is substantially unchanged during treatment.

BRIEF DESCRIPTION OF THE DRAWINGS

The above and other features and advantages of the present invention will become further known from the following detailed description when considered in conjunction with the accompanying drawings in which.

DETAILED DESCRIPTION OF THE PREFERRED EMBODIMENTS

Figure 1:
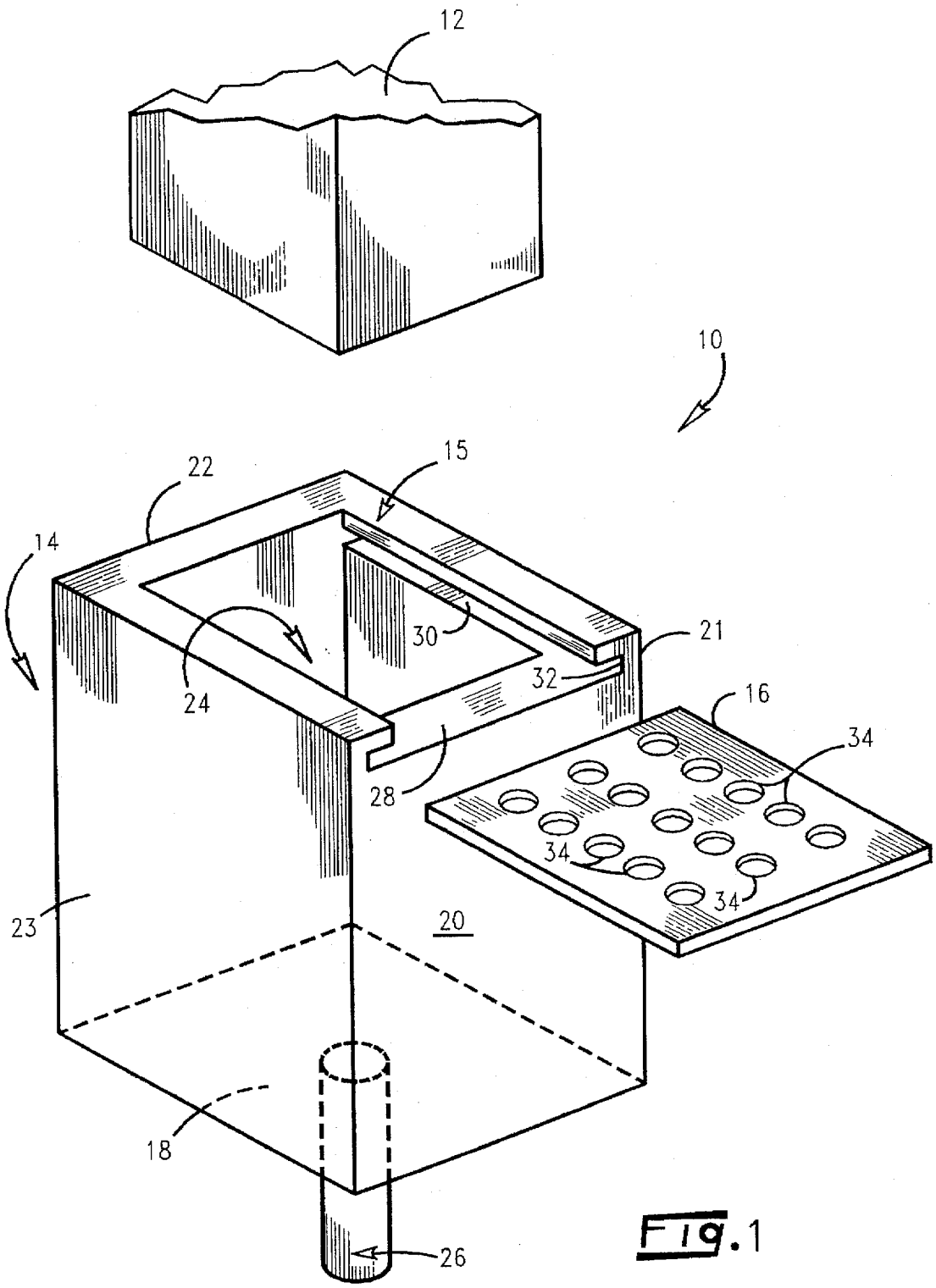
FIG. 1 is a perspective view of a preferred embodiment of the treating chamber for holding foam during treatment thereof in accordance with the present invention.

As used herein, the term "ink jet foam" will be understood to refer generally to reticulated or open cell foams having interconnected void spaces, i.e., porosity and permeability, of desired configuration which enable ink to be retained within the foam and to flow therethrough at a desired rate for delivery to a print head. Such foams are also preferably "felted", as explained below. Foams of this type are often polyether-polyurethanes and the manufacture of such foams is well known in the art. A commercially available example of ink jet foam is a felted open cell foam which is a polyurethane material made by the polymerization of a polyol and toluene diisocyanate, and is available under the trade name SIF FELT from Foamex of Eddystone, Pa.

The manufacture of ink jet foams typically involves a polymerization reaction. Reaction gases of the polymerization create an open cell structure within the polymerization product. The polymerization product is then typically cut into smaller buns of a size suitable for handling, for example 6-12 feet in length, and the buns reticulated, i.e., filled with a reactant gas such as hydrogen and oxygen, to further expand the cells.

In one method of manufacture, the reticulated buns are cut into small sheets (typically about 4 ft×6 ft×5 inches) and felted, i.e., pressed between hot plates (≈340° F.) which reduces the 5 inch dimension (the felted dimension) to about 1.6 inches. The resulting felted foam may then be cut into smaller units sized to fit into the ink cavity of an ink jet cartridge. It will be understood that the method and apparatus of the present invention may be used with virtually any size foam article. For example, large portions of foam may be treated, preferably after felting, and cut into portions sized for ink jet printing applications after treatment to remove NVR, or in the alternative, the foam may be cut into smaller portions and treated individually or as a group. If treated after felting and before the foam is cut into smaller sizes, the foam is preferably constrained to prevent dimensional change of the felted dimension only, since the outside edges of the foam are typically discarded after subsequent cutting of the foam into smaller portions.

The level of NVR in ink jet foams is typically from about 0.4% to about 3.0% by weight after felting, and it is desirable to reduce the level of NVR to less than about 0.2% (wt.) to provide ink jet foam having suitable printing attributes. Without being bound by theory, it is believed that felting of the foam significantly increases the amount of NVR in the foam. This increase in NVR during felting is believed to be due, at least in part, to degradation of the foam by hydrolysis involving moisture in the air and heat from the felting operation.

While the present invention is particularly suitable for treatment of felted foams, it will be understood that non-felted foams and other similar materials may also be treated as described herein.

As mentioned previously, it has been discovered that alcohol, such as isopropyl alcohol ("IPA") is an effective solvent for removing NVR from ink jet foam, but that IPA adversely affects the dimensional integrity of the foam and otherwise reduces the usefulness of the foam. It has been observed that foam contacted with IPA tends to undergo dimensional changes, such as swelling, which reduce the suitability of the foam for use in ink jet cartridges.

For example, any change in shape of the foam, such as from swelling, may prevent proper fit of the foam in the ink jet cartridge and thereby disadvantageously affect print performance. As will be appreciated, even the smallest alteration of the size, shape, permeability or other property of the foam may have a significant effect on the suitability of the foam for ink jet printing purposes.

With initial reference to FIG. 1, there is shown a preferred embodiment of a treatment chamber 10 configured to receive a portion of ink jet foam 12. It has been discovered that retaining ink jet foam, such as the foam 12, in the treatment chamber 10 prior to and during contact of the foam with a treating fluid effective in removing NVR from the foam, such as isopropyl alcohol ("IPA"), reduces undesirable dimensional distortion of the foam and other disadvantages normally encountered by previous cleaning techniques.

Following removal of NVR, the treating fluid is preferably removed from the foam, as by rinsing with a rinse fluid while the foam remains within the treatment chamber. The rinse fluid is preferably a solvent that does not swell the foam and which is miscible with the treating fluid. A preferred rinse fluid is deionized water, but other suitable rinse fluids include glycols and ink constituents which do not swell the foam and which evaporate without leaving residue.

The treatment chamber 10 preferably includes a substantially rigid box-shaped body 14 having open end 15 and a cover 16 slidably positionable adjacent the open end 15 of the body 14.

The body 14 may include a closed end 18 and a plurality of sidewalls 20, 21, 22, and 23 joined to one another along adjacent side edges and extending upwardly (as shown) from the closed end 18 to provide a five sided cavity 24 for receiving the foam 12. A conduit 26 preferably extends through a central portion of the closed end 18 in flow communication with the cavity 24 for delivering fluids into the cavity for treating foam, as will be described in more detail below.

A T-shaped 28 slot is provided along the exposed edge of the sidewall 20 and sidewalls 21 and 23 include undercut slots 30 and 32, respectively, which cooperate with the slot 28 for slidably receiving the cover 16 and frictionally retaining the cover on the body 14. In the alternative, the cover 16 may be clamped, bolted, or otherwise fixedly secured to the body 14 in order to maintain the dimensional integrity of the foam 12 during treatment thereof.

The cover 16 preferably includes a plurality of apertures 34 therethrough such that when the cover is installed on the body 14, fluid entering the cavity 24 through the conduit 26 may exit the cavity through the apertures 34 after passing through the foam 12 positioned within the cavity 24. The apertures 34 may be of virtually any size and number, it being preferred that the configuration of the apertures is sufficient to enable the fluid to exit the cavity 24 at substantially the same rate as it enters the cavity.

The foam 12 may be inserted into the treatment chamber by sliding the foam into the cavity 24 through the open end 15 of the body. The cover 16 is then slidably positioned within the slots 28, 30 and 32 to maintain the foam within the cavity 24.

As mentioned above, it has been discovered that ink jet foam may be positioned within the treatment chamber 10 prior to and during contact of the foam with a treating fluid to avoid dimensional distortion of the foam, such as swelling, and other disadvantages normally encountered in previous cleaning methods. Accordingly, the cavity is just slightly smaller than the foam 12 received therein such that the foam is slightly compressed to prevent void spaces between the foam and the holder such that fluid is forced to travel through the foam and does not flow between the foam and the holder.

Figure 2:
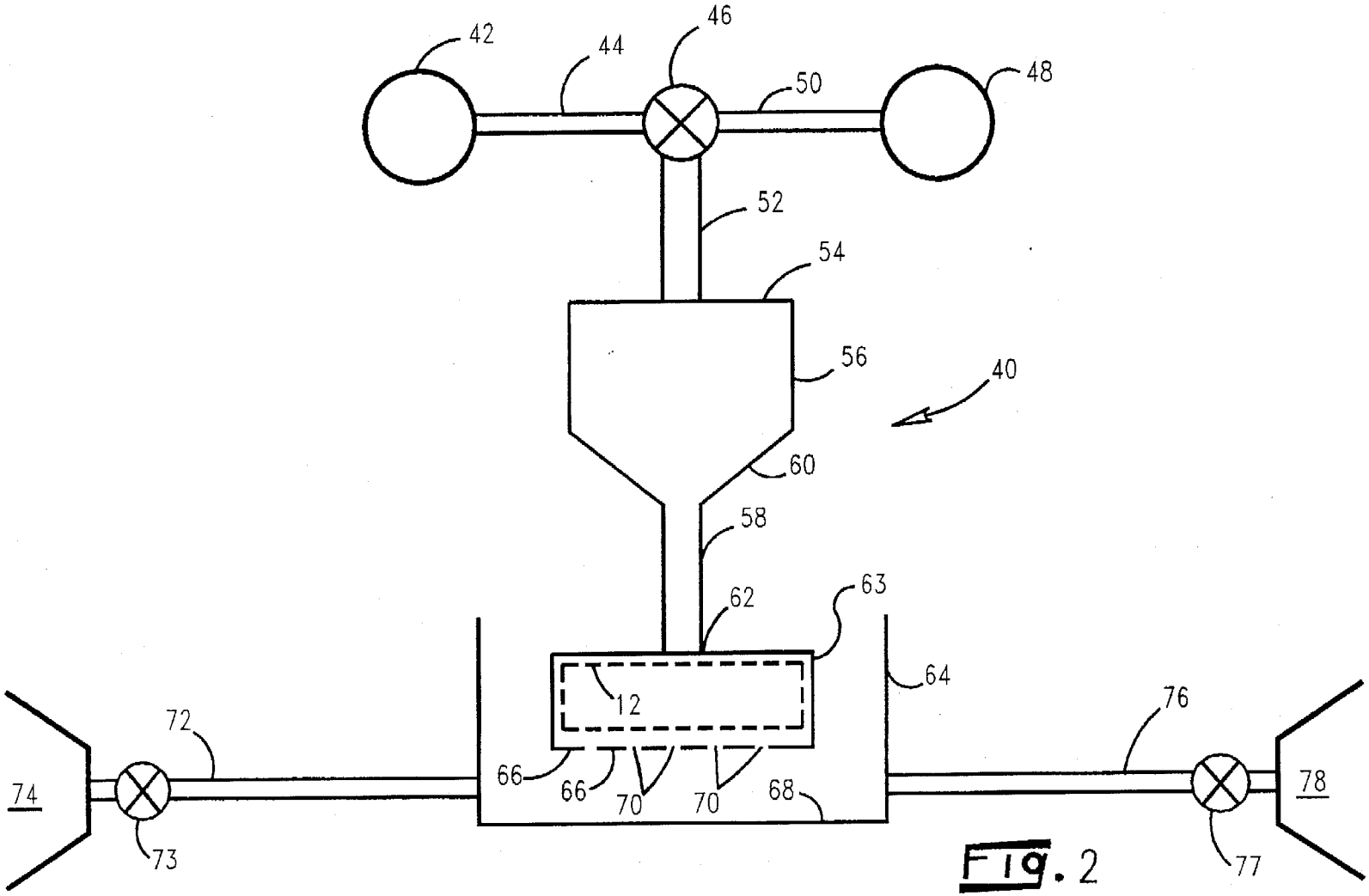
FIG. 2 is a schematic diagram of a preferred embodiment of a system for treating ink jet foam in accordance with the present invention.

With reference to FIG. 2, there is shown a schematic diagram of a batch system 40 for treating foam to remove NVR and other impurities which utilizes a treatment chamber such as the treatment chamber 10 to maintain the dimensional integrity of the foam during treatment. In accordance with the present invention, foam is positioned within the treatment chamber prior to and during contact of the foam with a treating fluid, such as IPA, to prevent dimensional changes to the foam. Contact between the foam and the treating fluid is preferably accomplished by forcing the treating fluid through the foam, as by use of a pump to direct a pressurized flow of treating fluid through the foam. The use of a pressurized flow is preferred to ensure cleaning of the smaller pores within the foam.

The foam is then rinsed with a rinse fluid, such as deionized water, in a similar manner and thereafter dried as by passing an inert gas such as nitrogen through the foam. In this regard, it is noted that the foam is essentially free of treating fluid after rinsing and may be removed from the treatment chamber. As mentioned previously, the foam is preferably maintained within the treatment chamber at least until removal of treating fluid from the foam is completed to prevent swelling of the foam.

With further reference to FIG. 2, the system 40 may include a source 42 of an inert gas, such as nitrogen, a conduit 44 in flow communication with the source 42 of nitrogen and a two-way valve 46, a source 48 of subatmospheric pressure, a conduit 50 in flow communication with the source 48 of subatmospheric pressure and the valve 46, a conduit 52 in flow communication with the valve (and hence selectively in flow communication with conduits 44 and 50) and an upper portion 54 of a fluid reservoir 56, and a conduit 58 in flow communication with a lower portion 60 of the fluid reservoir 56 and an upper portion 62 of a treatment chamber 63 positioned within a treatment vessel 64. As will be appreciated, the conduits 44 and 50 may be selectively made in flow communication with the conduit 52 by manipulation of the valve 46.

The treatment chamber 63 is preferably similar in construction to the treatment chamber 10 described in connection with FIG. 1 and is positioned such that a cover 66 of the treatment chamber 63 (corresponding to the cover 16 of the treatment chamber 10) is spaced above and faces a surface 68 of the treatment vessel 64 so that apertures 70 in the cover 66 (corresponding to the apertures 34 of the treatment chamber 10) are in flow communication with the treatment vessel 64 and the conduit 62 (which corresponds to the conduit 26 of the treatment chamber 10).

To facilitate introduction and removal of treatment fluid and rinse fluid into the treatment vessel 64, the treatment vessel is preferably in flow communication with both a source of treatment fluid and rinse fluid. For example, the system 40 may also include a conduit 72 having valve 73 in flow communication with a source 74 of treatment fluid and a conduit 76 having a valve 77 and in flow communication with a source 78 of rinse fluid. Optionally, an additional treatment vessel (not shown) may be provided. In this event, the source of treating fluid is preferably connected to the vessel 64 and the source of rinse fluid connected to the additional treatment vessel. As will be appreciated, the treatment chamber 63 is moved from the vessel 64 to the additional vessel for rinsing of the foam.

The system 40 may be operated to remove NVR and other impurities from ink jet foam without the disadvantages associated with conventional treatment systems. For example, in a preferred method for treating ink jet foam using the system 40, ink jet foam such as the foam 12 is preferably positioned within the treatment chamber 63 in the same manner as described previously for placing the foam 12 in the treatment chamber 10. The valve 46 is closed and the treatment vessel 64 is charged with a treatment fluid, such as IPA or a mixture of IPA and deionized water, introduced from the source 74 into the treatment vessel 64 via conduit 72. Subatmospheric pressure may be applied to the conduit 50 (i.e. valve 46 is manipulated so that conduits 50 and 52 are in flow communication with one another) to draw a desired amount of treatment fluid from the treatment vessel 64, through the foam 12 in the treatment chamber 63, and into the reservoir 56 via the conduit 58. Nitrogen may be introduced from the source 42 so that it flows through the reservoir 56 via conduits 44 and 52 to flush the treatment fluid from the reservoir 56 back to the treatment vessel 64 through conduit 58 and the foam 12. This procedure is preferably repeated several times, after which the treatment fluid may be drained from the treatment vessel through conduit 72 and returned to the source 74 of treatment fluid for recovery or disposal.

The treatment vessel 64 may then be charged with rinse fluid from the source 78 in a similar manner and the foam rinsed by passing the rinse fluid through the foam several times in the same manner as the treatment fluid. The rinse fluid may then be drained from the treatment vessel and nitrogen gas passed through the foam to dry the foam. If an additional treatment vessel is provided, as mentioned above, the treatment chamber may be removed from the treatment vessel 64 and placed into the additional vessel for treatment with the rinse fluid. After rinsing, the foam may then be removed from the treatment chamber and further dried, as in a convection oven.

Treatment of foam in accordance with the present invention has been observed to enable reduction of NVR and impurities which unfavorably affect print performance to levels of less than about 0.2% without adversely affecting the dimensional integrity of the foam. For example, it has been observed that foam treated in accordance with the present invention does not undergo any significant swelling and has substantially the same dimensions after treatment as before treatment. Thus, treatment of ink jet foam in accordance with the present invention enables foam to be treated to significantly improve its suitability for ink jet printing.

Figure 3:
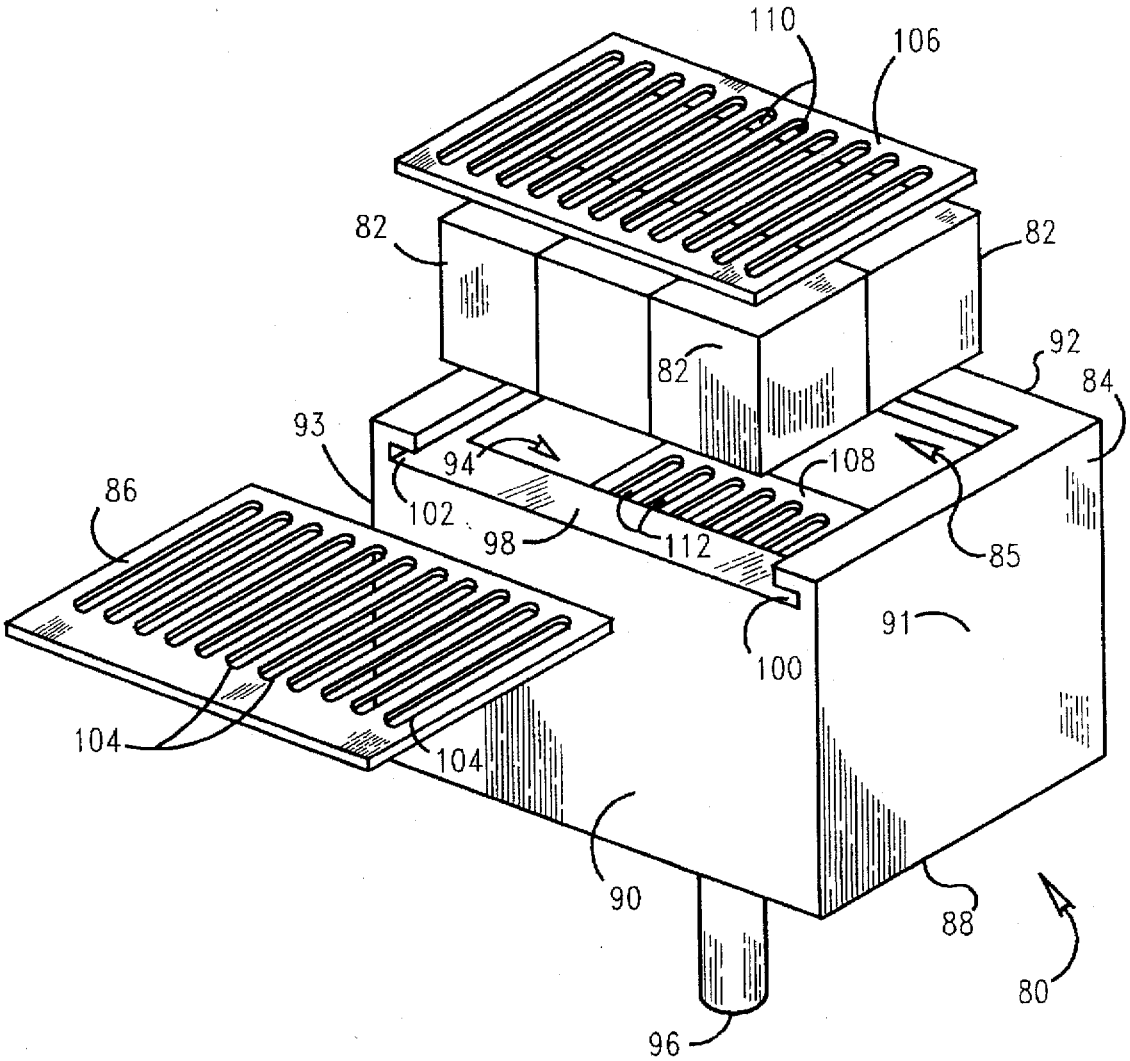
FIG. 3 is a perspective view of an alternate embodiment of the treating chamber for holding foam.

With reference to FIG. 3, there is shown another embodiment of a treatment chamber 80 for retaining a plurality of ink jet foam portions 82 during treatment thereof. The treatment chamber 80 includes a generally box-shaped body 84 having open end 85 and a cover 86 slidably positionable adjacent the open end 85 of the body 84.

The body 84 may preferably include a closed end 88 and a plurality of sidewalls 90, 91, 92, and 93 joined to one another along adjacent side edges and extending upwardly from the closed end 88 to provide a cavity 94 for receiving the foam 82. A conduit 96 preferably extends through the closed end 88 at the midpoint thereof so that it is in flow communication with the cavity 94 for delivering fluids into the cavity for treating the foam, as will be described in more detail below.

A T-shaped slot 98 provided along the exposed edge of the sidewall 90 is configured for slidably receiving the cover 86, and sidewalls 91 and 93 include undercut slots 100 and 102, respectively, which cooperate with the slot 98 for slidably receiving the cover 86. The cover 86 preferably includes a plurality of apertures 104 therethrough such that when the cover is installed on the body 84, fluid entering the cavity 94 through the conduit 96 may exit the cavity through the apertures 104 after passing through the foam 82 positioned within the cavity 94. The apertures may be of virtually any size and number, it being preferred that the configuration of the apertures is sufficient to enable the fluid to exit the cavity 94 at substantially the flame rate as it enters the cavity.

The foam 82 may be inserted into the treatment chamber by sliding the foam into the cavity 94 through the open end 85 of the body. The cover 86 is then slidably positioned within the slots 98, 100 and 102 to maintain the foam within the cavity 94.

Optionally, the treatment chamber 80 may include sizing plates, such as plates 106 and 108 having apertures 110 and 112, respectively, for positioning above and/or below the foam portions 82 if necessary to provide a better fit between the foam portions 82 and the treatment chamber 80.

Figure 4:
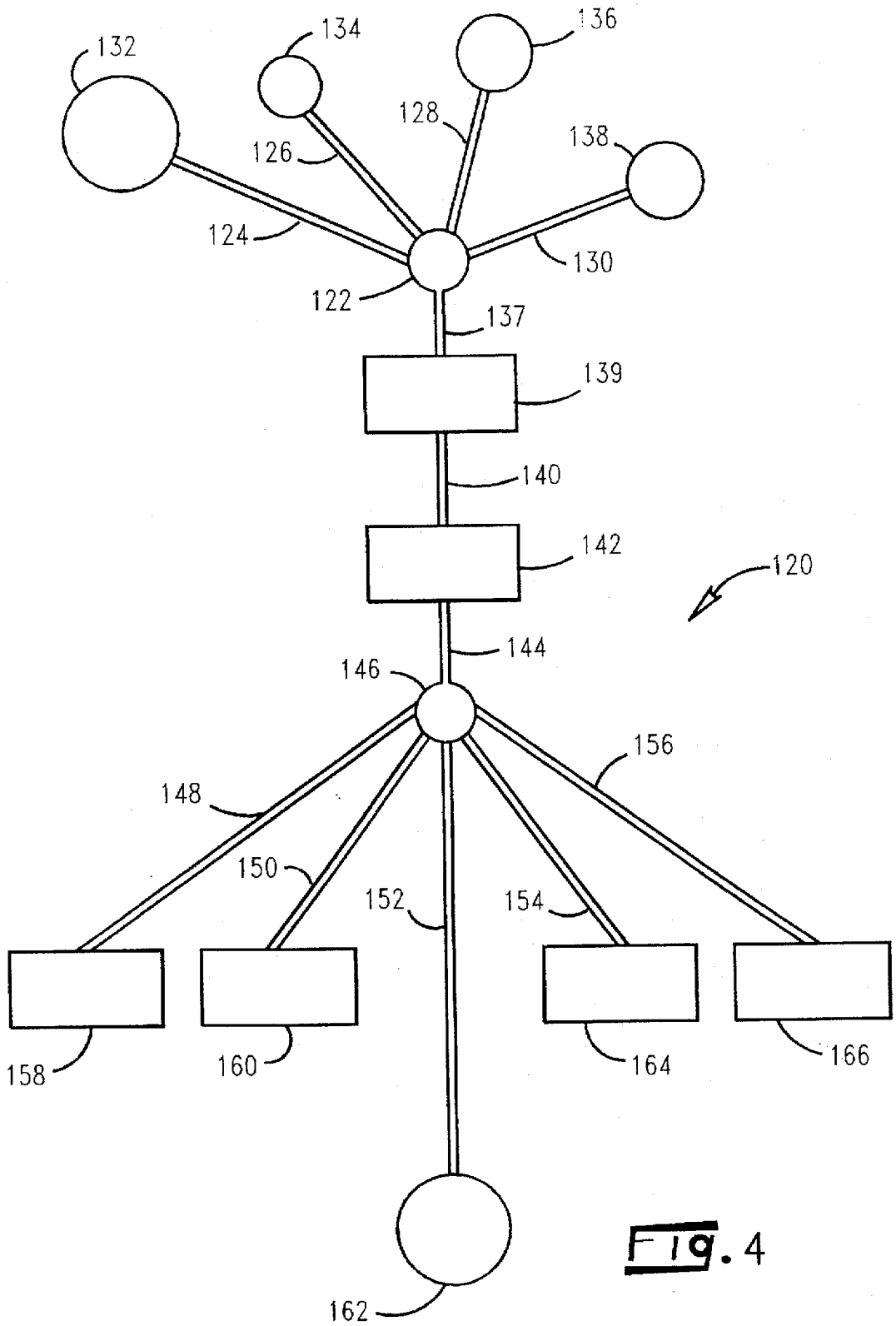
FIG. 4 is a schematic diagram of an alternate embodiment of a system for treating ink jet foam.

FIG. 4 shows a schematic diagram of an alternate embodiment of a system 120 for treating ink jet foam. The system 120 includes a valve system 122 in selective flow communication with conduits 124, 126, 128, and 130, which are in flow communication, respectively, with a source 132 of fresh rinse fluid, such as deionized water, a source of subatmospheric pressure 134, a source 136 of inert gas, and a source 138 of fresh treatment fluid, such as IPA. The valve system 120 further includes a conduit 137 which is in selective flow communication with the conduits 124, 126, 128, and 130.

The system 120 may also include a reservoir 139 in flow communication with conduit 137, a conduit 140 in flow communication with the reservoir 139 and a treatment chamber 142, a conduit 144 in flow communication with the treatment chamber 142 and a second valve system 146. In a preferred embodiment, the conduit 144 corresponds to the conduit 26 described in connection with the treatment chamber 10 of FIG. 1.

The valve system 146 is in selective flow communication with conduits 148, 150, 152, 154, and 156, which are in flow communication, respectively, with a first source 158 of treatment fluid (such as IPA), a second source 160 of treatment fluid, a waste recovery unit or sewer (referred to generally as 162), a first source of 164 rinse fluid (such as deionized water), and a second source of rinse fluid 166.

Operation of the system 120 is similar to that of the system 40 described in connection with FIG. 2, except that different treatment and rinse fluids may more conveniently be used and fresh rinse and treatment fluids introduced as desired. For example, the first source of treatment fluid may provide IPA and the second source may provide a mixture of IPA and deionized water or yet another solvent, with fresh treatment and rinse fluids available from the sources 138 and 132, respectively.

Figure 5:
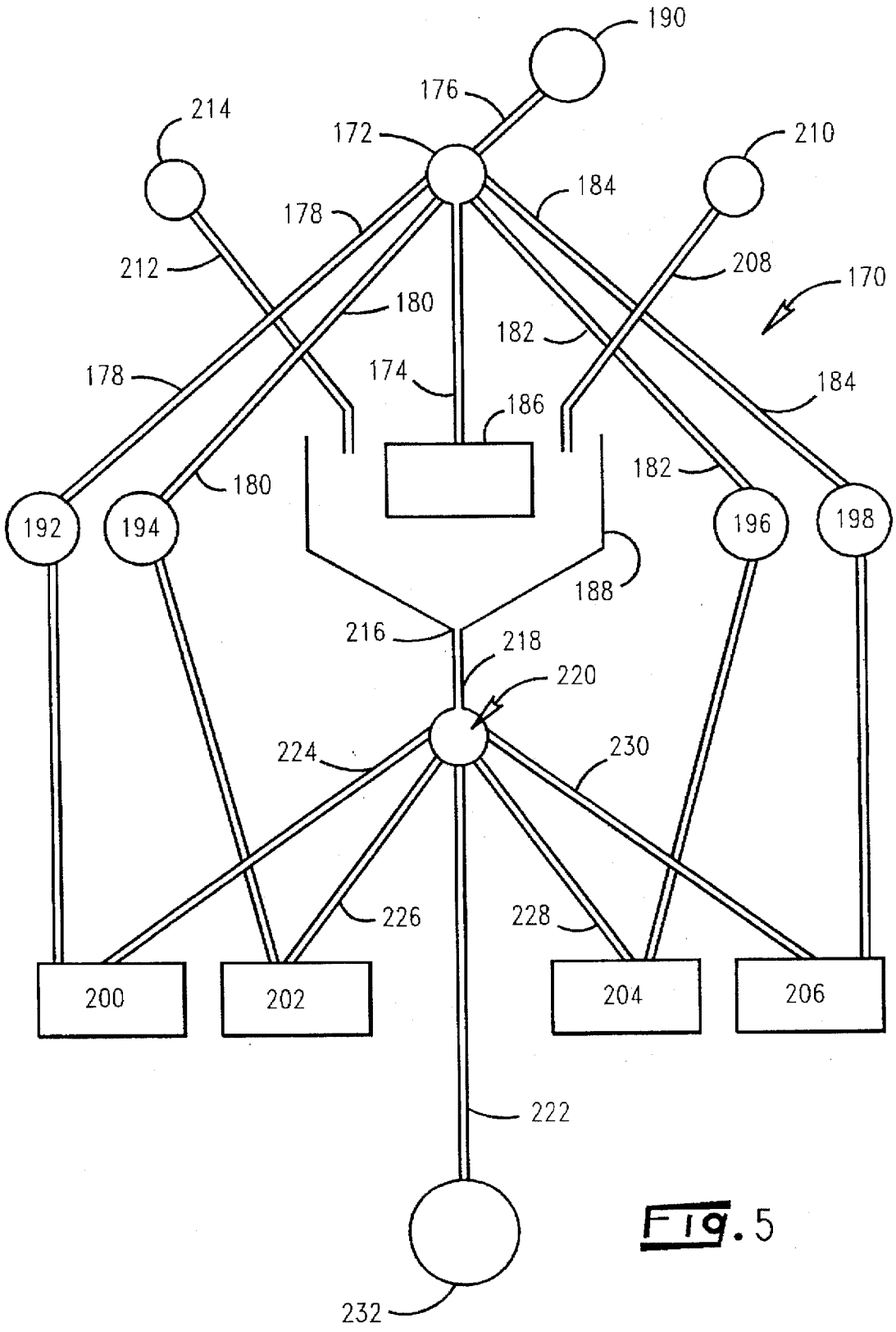
FIG. 5 is a schematic diagram of another embodiment of a system for treating ink jet foam.

FIG. 5 shows a schematic diagram of still another embodiment of a system 170 for treating ink jet foam in which treatment and rinse fluids are pumped through the foam rather than back and forth through the foam. In addition, an inert gas, such as nitrogen, may be passed through the system between fluid changes to avoid mixing of the fluids.

The system 170 preferably includes a valve system 172 in selective flow communication with conduits 174, 176, 178, 180, 182, and 184. Conduit 174 is in flow communication with a treatment chamber 186 positioned within a treatment vessel 188, and the conduit 174 preferably corresponds to the conduit 26 described in connection with the treatment chamber 10 of FIG. 1. Conduit 176 is in flow communication with a source 190 of inert gas such as nitrogen. Conduits 178, 180, 182, and 184 are in flow communication with in-line pumps 192, 194, 196, and 198, respectively, which are in flow communication with a first source 200 of treatment fluid, a second source 202 of treatment fluid, a first source 204 of rinse fluid, and a second source 206 of rinse fluid, respectively.

The system 170 also preferably includes a conduit 208 in flow communication with an additional source 210 of treatment fluid and the treatment vessel 188 for introducing fresh treatment fluid into the treatment vessel, if desired, and a conduit 212 in flow communication with an additional source 214 of rinse fluid and the treatment vessel 188 for introducing fresh rinse fluid into the treatment vessel 188, if desired. A lower portion 216 of the treatment vessel 188 is in flow communication with a drain conduit 218 for draining fluids from the treatment vessel (preferably by gravity) to a valve system 220 for selective routing of drained fluids for re-use or disposal.

With further reference to FIG. 5, the valve system 220 is in selective flow communication with conduits 222, 224, 226, 228, and 230, which are in flow communication with a waste recovery unit or sewer (referred to generally as 232), the first source 200 of treatment fluid, the second source 202 of treatment fluid, the first source 204 of rinse fluid, and the second source 206 of rinse fluid.

Operation of the system 170 is similar to that of the system 40 described in connection with FIG. 2 and of the system 140, except that fluid is forced through the foam in one direction rather than back and forth through the foam. Also, inert gas may be passed through the foam between each fluid cycle to force additional fluid from the foam and reduce mixing of the fluids of the different cycles. To treat ink jet foam using the system 170, foam such as the foam 12 is preferably positioned within the treatment chamber 186 within the treatment vessel 188 in the same manner as described previously for placing the foam 12 in the treatment chamber 10. The foam in the treatment chamber 186 is exposed to treating solution introduced from the source 200 (via conduit 178 and pump 192). The treating solution may then be drained from the vessel 188 via conduit 218 and valve system back to the source 200 for recirculation back through the foam or for storage. Preferably, the treating solution is recirculated through the foam several times and then drained to recovery unit 232. Inert gas from the source 190 is then preferably forced through the foam to remove remaining treating fluid, after which the foam may be contacted with a second dose of a treating solution from the source 202 (via pump 194 and conduit 180) in a similar manner. Amounts of fresh or a different treating solution may be added at any time from source 210 via conduit 208 if desired.

The foam may then be rinsed by introducing rinse fluid from the source 204 (via conduit 182 and pump 196), preferably recirculating the rinse fluid through the foam several times before draining the rinse fluid from the source 204 to the recovery unit or sewer 232. The foam may then be contacted with a second dose of a rinse solution from the source 206 (via pump 198 and conduit 184) in a similar manner. Amounts of fresh or a different rinse solution may be added at any time from source 214 via conduit 212 if desired.

Finally, inert gas such as nitrogen from source 190 (via conduit 176) may be passed through the foam to dry the foam. The foam may then be removed from the treatment chamber and further dried, as in a convection oven.

The foregoing description of certain embodiments of the present invention has been provided for purposes of illustration only, and it is understood that numerous modifications or alterations may be made without departing from the spirit and scope of the invention as defined in the following claims.

What is claimed is:

1. A method for treating reticulated material for ink jet print heads, the method comprising the steps of:

providing a reticulated material subject to having alteration in shape a first length, a first width, and a first height, interconnected void spaces within an interior region of the reticulated material, and impurities within the interconnected void spaces;

positioning the reticulated material within an interior portion of a substantially rigid treatment chamber having a length, a width, and a height, wherein the length, width, and height of the interior portion of the treatment chamber correspond substantially to the first length, width, and height of the reticulated material, the treatment chamber including means for introducing fluid into the interior portion of the treatment chamber and means for removing fluid from the treatment chamber;

introducing a treating fluid into the interior portion of the treatment chamber and contacting at least some of the impurities within the interconnected void spaces of the reticulated material, the impurities being soluble in the treating fluid;

withdrawing the treating fluid from the interior portion of the treatment chamber to remove solubilized impurities from the reticulated material;

introducing a rinse fluid into the treatment chamber and thereafter removing the rinse fluid from the treatment chamber to remove substantially all of the treating fluid from the reticulated material;

removing the reticulated material from the treatment chamber, wherein the reticulated material has a second length, width and height after removal from the treatment chamber which is substantially the same as the first length, width, and height of the material.

2. The method of claim 1, wherein the reticulated material comprises polyurethane foam.

3. The method of claim 1, wherein the treating fluid comprises isopropyl alcohol.

4. The method of claim 1, wherein the rinse fluid comprises deionized water.

5. The method of claim 1, further comprising the step of passing an inert gas through the reticulated material subsequent to the step of introducing the rinse fluid.

6. The method of claim 5, wherein the inert gas comprises nitrogen.

* * * * *